US005489227A

United States Patent [19]

Ishida et al.

[11] Patent Number: 5,489,227

[45] Date of Patent: Feb. 6, 1996

[54] PROTECTIVE COWLING FOR OUTBOARD MOTOR

[75] Inventors: Hitoshi Ishida; Kazuhiro Okuzawa; Kenji Kawamukai; Takaji Kawai; Akinori Yamamoto, all of Hamamatsu, Japan

[73] Assignee: Sanshin Kogyo Kabushiki Kaisha, Hamamatsu, Japan

[21] Appl. No.: 301,328

[22] Filed: Sep. 6, 1994

[30] Foreign Application Priority Data

Sep. 3, 1993 [JP] Japan ..... 5-242225

[51] Int. Cl.[6] ..... B63H 21/26

[52] U.S. Cl. ..... 440/77; 440/88

[58] Field of Search ..... 440/76, 77, 88, 440/900; 181/229, 264, 267, 266, 268, 269, 270, 272, 275

[56] References Cited

U.S. PATENT DOCUMENTS

| | | | |
|---|---|---|---|
| 3,610,198 | 10/1971 | Alexandrowicz | 440/77 |
| 4,379,702 | 4/1983 | Takada et al. | 440/77 |
| 4,571,193 | 2/1986 | Takada et al. | 440/77 |
| 5,046,976 | 9/1991 | Kobayashi et al. | 440/77 |
| 5,052,960 | 10/1991 | Kato | 440/77 |
| 5,069,644 | 12/1991 | Kobayashi et al. | 440/77 |
| 5,181,870 | 1/1993 | Arai et al. | 440/77 |
| 5,181,871 | 1/1993 | Hiraoka et al. | 440/77 |

*Primary Examiner*—Stephen Avila
*Attorney, Agent, or Firm*—Knobbe, Martens, Olson & Bear

[57] ABSTRACT

A protective cowling arrangement for an outboard motor that provides an atmospheric air inlet having a pair of openings disposed above the engine for permitting atmospheric air to flow into the protective cowling for engine combustion. One of these openings is disposed in part above components of the engine which should not be contacted by water and this opening is substantially smaller than the other opening. An engine cover is also affixed to the engine and obscures the smaller opening to afford further water protection.

10 Claims, 8 Drawing Sheets

PROTECTIVE COWLING FOR OUTBOARD MOTOR

BACKGROUND OF THE INVENTION

This invention relates to a protective cowling for an outboard motor and more particular to an improved protective cowling arrangement for permitting the induction of air for engine operation and precluding the entry of water that could damage the engine and/or its accessories.

As is well known, outboard motors include a power head that contains the powering internal combustion engine and a protective cowling which encircles the engine for its protection from the elements and so as to improve the appearance of the outboard motor. However, the engine requires substantial amounts of airflow for its combustion process. Therefore, it is necessary to provide air openings in the protective cowling through which air may be drawn from the atmosphere for the engine operation. This gives rise to a number of design challenges.

Normally it has been the practice to provide an air inlet at the upper rear portion of the protective cowling which atmospheric air can be drawn for the engine combustion. Such inlet openings are normally formed by a recess that is formed in the main cowling member and which has one or more vertically disposed openings that permit flow of air from this recess to the interior of the cowling. The recess is enclosed by a further cover member that is affixed to the main cover member and which defines either by itself or in combination with the main cover member an atmospheric air opening through which the atmospheric air flows to the cavity which is defined by the main cowling member and the cover member. The air flows through the openings into the interior of the main cowling member.

Normally these openings for the atmospheric air face rearwardly so that water spraying during the operation of the watercraft will not enter them. In addition, normally some form of baffling or labyrinthian type flow arrangement is provided in the inlet device for assisting in separating water from any air that passes into the interior of the protective cowling.

The rearwardly facing air inlet openings, however, can cause a problem in that when the watercraft is suddenly decelerated. Water may splash up and enter the opening. Although the baffling can provide some assistance and assurance against water entry into the interior of the protective cowling, this is an area that can be subject to improvement.

It is, therefore, a principal object of this invention to provide an improved protective cowling for an outboard motor.

It is a further object of this invention to provide an air inlet arrangement for the outboard motor protective cowling that will permit adequate airflow and will ensure against water impingement upon the engine and its accessories.

Obviously it is possible to restrict the size of the openings in the protective cowling that communicate the interior with the air inlet chamber. However, if these openings are restricted, then the performance of the engine can deteriorate, particularly under wide open, full throttle conditions.

It is, therefore, a still further object of this invention to provide an improved protective cowling arrangement that has air openings for adequate air flow but wherein the openings are disposed and arranged so that critical components of the engine can be protected.

Obviously certain portions of the engine are less prone to attack from corrosion and damage from the water than others. For example, the ignition system including the spark plugs, spark coils and spark wires, can be seriously affected if water impinges upon them. Misfiring can occur or in extreme situations the actual running of the engine can be interrupted. In a similar manner, the carburetion and/or throttle arrangement and charge forming system can be subject to deterioration if water impinges upon it. Of course, these problems are particularly aggravated if the engine is operated in the marine environment since the salt water will cause much more corrosion than fresh water.

It is, therefore, a still further object of this invention to provide an improved protective cowling arrangement for an internal combustion engine that permits adequate airflow to the engine for its combustion but wherein the openings are disposed and arranged in such a way as to ensure that water will not impinge upon critical portions of the engine and its accessories which may be adversely affected by water.

SUMMARY OF THE INVENTION

This invention is adapted to be embodied in a protective cowling arrangement for an outboard motor that has an internal combustion engine and a surrounding protective cowling that includes a main cowling member which overlies and substantially encloses the engine. An air inlet arrangement is provided for admitting atmospheric air for engine combustion through the protective cowling. This air inlet arrangement includes at least a pair of air inlet openings formed in the main cowling member and which are enclosed in part by a cover member which defines at least in part an atmospheric air inlet. One of the openings is disposed closer to components of the engine and its accessories that require more water protection than the other and in accordance with the invention this opening is made smaller in effective cross-sectional area.

In accordance with another feature of the invention, an inner water cover is mounted over the engine and beneath the air inlet openings for affording further water protection.

DETAILED DESCRIPTION OF THE PREFERRED EMBODIMENT OF THE INVENTION

Figure 1:
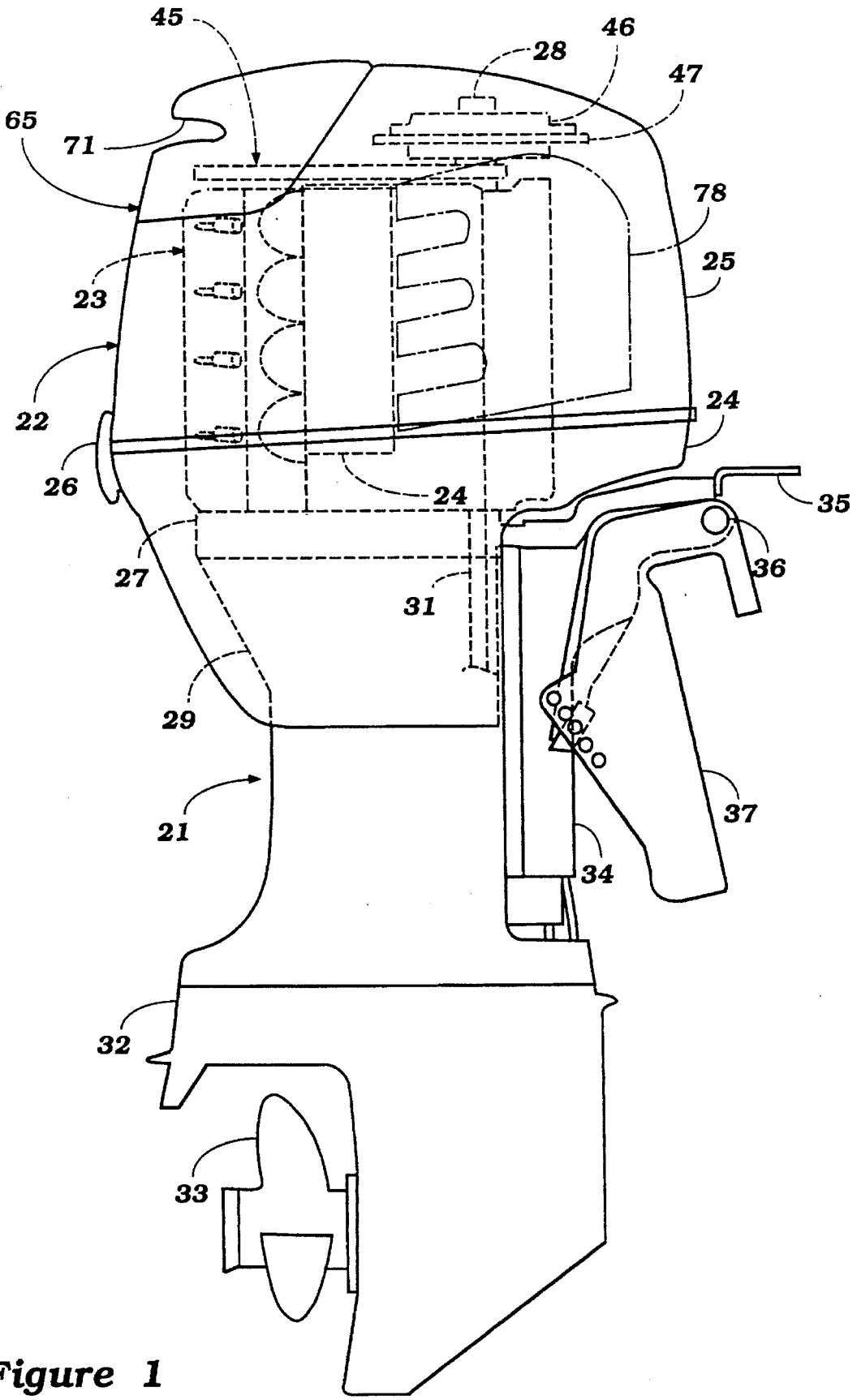
FIG. 1 is a side elevational view of an outboard motor constructed in accordance with an embodiment of the invention.

Referring now in detail to the drawings and initially primarily to FIG. 1, an outboard motor constructed in accordance with an embodiment of the invention is identified generally by the reference numeral 21. The outboard motor 21 includes a power head, indicated generally by the reference numeral 22 which is comprised of an internal combustion engine 23 and a surrounding protective cowling. The protective cowling is comprised principally of a lower tray member 24 and an upper main cowling member 25 that are detachably connected to each other by means including a latch 26. The tray 24 is, as is typical with this practice, formed from a light weight, high strength material such as aluminum or aluminum alloy. The main cowling member 25 is formed from a material which is also light weight such as a molded fiberglass reinforced resin. As will become apparent as the description proceeds, the main cowling member 25 is formed of a multi-part construction.

The engine 23 in the illustrated embodiment is depicted as being a four cylinder, in-line engine operating on a four-stroke principal. It will be readily apparent, however, to those skilled in the art how the invention can be practiced with engines of other types.

As is typical with outboard motor practice, the engine 23 is supported on a support plate 27 with its crankshaft 28 rotating about a vertically extending axis. The support plate 27 is positioned at the upper end of a drive shaft housing, indicated generally by the reference numeral 29 and which rotatably journals a drive shaft 31 that is connected to the engine crankshaft 28 in a known manner.

The drive shaft 31 depends into a lower unit 32 where it drives a propeller 33 through a conventional forward neutral reverse transmission (not shown).

A steering shaft (not shown) is coupled to the drive shaft housing 29 and is journaled for steering movement within a swivel bracket 34 for steering of the outboard motor 21 in a well known manner. A tiller 35 is affixed to the upper end of the steering shaft for the steering of the outboard motor 21. The swivel bracket 34 is, in turn, pivotally connected by means of a pivot pin 36 to a clamping bracket 37 that includes means for providing a detachable connection to a transom of an associated watercraft (not shown).

Except for the construction of the protective cowling and the protection of the engine 23 from water damage, the construction of the outboard motor as thus far described may be considered to be conventional and since the invention deals primarily with the areas noted, further details of the construction of the outboard per se are not believed to be necessary to understand the construction and operation of the invention.

Although the constructional details of the engine 23 are generally independent of the invention, the layout of certain of the components of the engine 23 and particularly those which may be damaged by water, particularly when operating in a marine environment, are important. Thus a general discussion of the construction of the engine 23 will follow primarily by reference to FIGS. 2 and 3, although some of the components also appear in broken lines or in phantom in FIG. 1. Basically, the engine 23 includes a cylinder block 38 in which the cylinder bores are formed. As has been noted, the engine crankshaft 28 rotates about a vertically extending axis and therefore the axes of the cylinder bores extend in a generally horizontal plane. Although the invention is depicted in conjunction with an in-line type of engine where the cylinders are vertically spaced from each other, it should be readily apparent to those skilled in the art that the invention may also be employed in conjunction with engines having other cylinder configurations or, in fact, rotary engines.

The pistons in the cylinder bores are connected by means of connecting rods, none of which are shown, to the crankshaft 28 for its driving. The crankshaft 28 rotates within a crankcase chamber formed by the lower portion of the cylinder block 38 and a crankcase member 39 that is detachably affixed to the cylinder block 38 in a well known manner. Due to the vertical positioning of the crankshaft, in the illustrated embodiment, the crankcase member 39 is disposed at the front of the power head 22. Again, however, this is merely a preferred embodiment.

A cylinder head 41 is affixed to the end of the cylinder block 38 opposite from the crankcase member 39 and at the rear of the power head 22. Since the engine is operated on a four-stroke cycle, the intake and exhaust passages for the engine are formed in the cylinder head 41 and these include an integral intake manifold having individual runners 42 serving each cylinder of the engine 23. The engine 23 is depicted as being of the single overhead cam type and, therefore, a camshaft 43 is rotatably journaled within the cylinder head 41 in any well known manner and is contained within a cam chamber formed by the cylinder head and a cam cover 44 that is affixed to the cylinder head in any known manner.

The camshaft 43 is driven by a timing mechanism from the crankshaft 28 so as to rotate at one-half crankshaft speeds, as is well known in this art. In the illustrated embodiment, a timing belt arrangement, indicated generally by the reference numeral 45, is provided for this drive. The timing belt drive 45 includes a sprocket that is affixed to the upper end of the crankshaft 28 and this sprocket lies beneath a flywheel magneto, indicated generally by the reference numeral 46 and which has a starter gear 47 affixed thereto. The starter gear 47 is driven in a known manner by a starter motor (not shown) for electric starting of the engine 23.

In addition to the intake manifold 42 formed integrally with the cylinder head 41, the engine 23 is also provided with an induction system which includes an air inlet device, indicated generally by the reference numeral 48 and which is disposed on one side of the crankcase member 39. The air inlet device 48 includes a silencing system and has a downwardly facing air inlet opening 49 through which atmospheric air is drawn from within the protective cowling and specifically the main cowling member 25. The way this atmospheric air is introduced into the cowling assembly of the power head 22 will be described later and this forms a major portion of the invention.

The air inlet device 48 supplies air to a plurality of inlet pipes 51, one for each cylinder of the engine, in accordance with the illustrated embodiment. The air inlet pipes 51, in turn, serve respective carburetors 52, each of which is mounted on a respective intake manifold runner 42 for serving the individual cylinders of the engine 23. Although the invention may be employed in conjunction with fuel injected engines, it has particularly utility and conjunction with carbureted engines because of the desirability of protecting not only the carburetors 52 but certain linkage associated therewith, which will now be described. Of course, it should be understood that injected engines also include components which may be well served by the protective features of the invention.

As is typical, the carburetors 52 have throttle valves which are controlled by means of a throttle linkage system, indicated generally by the reference numeral 53 and which is exposed at the intake side of the engine. This linkage system includes a plurality of interconnected links which could be damaged if they are exposed to water, particularly if operating in a marine environment.

The linkage system 53 is operated under a remote operator control in a known manner and is also coupled to an accelerating pump 54 that is mounted at the top of the carburetors 52 on the intake side of the engine. This accelerating pump 54 also requires protection from the elements and particularly from water or the like.

In addition to the throttle mechanism, each carburetor 52 is provided with a choke valve that is operated through a linkage system, indicated generally by the reference numeral 55 by means which include a thermally responsive unit 56 and an electric solenoid 57. Again, this mechanism is delicate and does require protection from water and to ensure against the likelihood of corrosion.

The side of the engine opposite the intake side thus far described is the exhaust side of the engine and this includes an exhaust manifold and exhaust system which is formed primarily internally in the cylinder head 41 and cylinder block 38. For this reason, the exhaust side of the engine does not require as much protection from the elements as does the intake side. It will be apparent, however, to those skilled in the art how the construction can provide water protection on the exhaust side as well as the intake side, if desired or if necessary.

The construction by which atmospheric air is delivered to the interior of the protective cowling will now be described by primary reference to FIGS. 1–3, 6–8, 10 and 11. It has been noted that the main cowling member 25 actually is made up of a multi-piece construction and this deals with the arrangement for delivering atmospheric air to the interior of this protective cowling for engine combustion.

The rear upper surface of the main cowling member 25 is provided with a somewhat invented portion so as to form a recess, indicated generally by the reference numeral 58 and which is defined by a lower wall 59 that has an upstanding portion 61 at its rear end which is generally concave so as to provide a relatively large volume, for a reason which will be described. The lower wall 59 is provided with a pair of air inlet openings 62 and 63 that are defined by respective upstanding walls 64 and 65, respectively.

Figure 2:
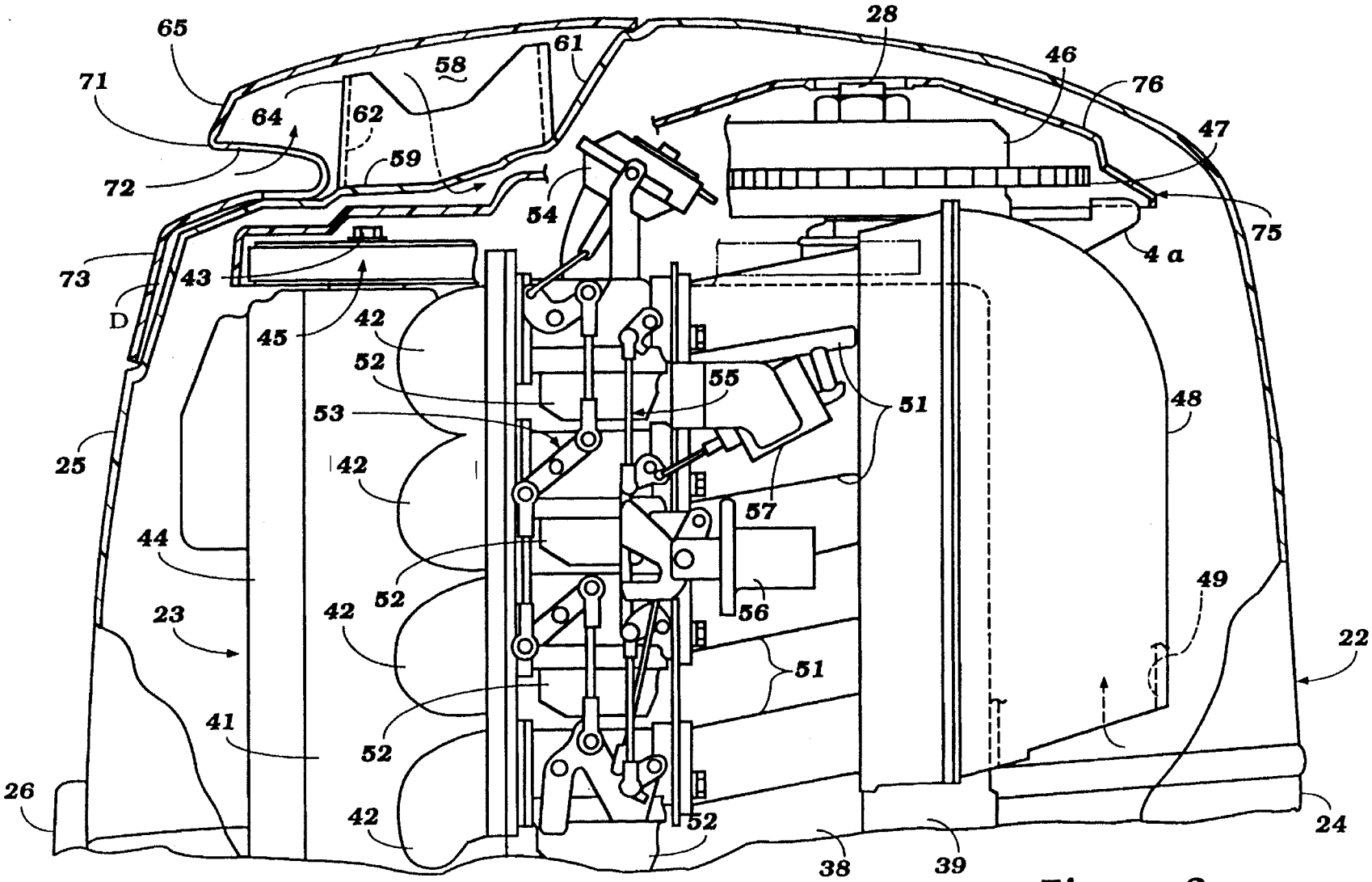
FIG. 2 is an enlarged side elevational view of the power head of the outboard motor with a portion of the protective cowling broken away so as to more clearly show the construction.

As may be seen best in FIG. 2, these upstanding walls extend up to the upper periphery of the recess 58 but are provided with some cutouts at their upper ends so as to permit free airflow into them while maintaining a substantially upstanding wall around the openings 62 and 63 so as to inhibit water entry. It will be noted that the opening 62 is disposed over the exhaust side of the engine where there are no critical components requiring any special water protection and therefore the opening 62 is substantially larger than the opening 63 which is disposed above the induction system including the carburetors 52, throttle linkage 53, choke linkage 55 and actuators 56 and 57 as well as the accelerating pump 54. Also, it should be noted that the opening 63 is disposed so that it is closely adjacent the cylinder block 38 and cylinder head 41 and spaced as far as possible from the linkages described.

Figure 8:
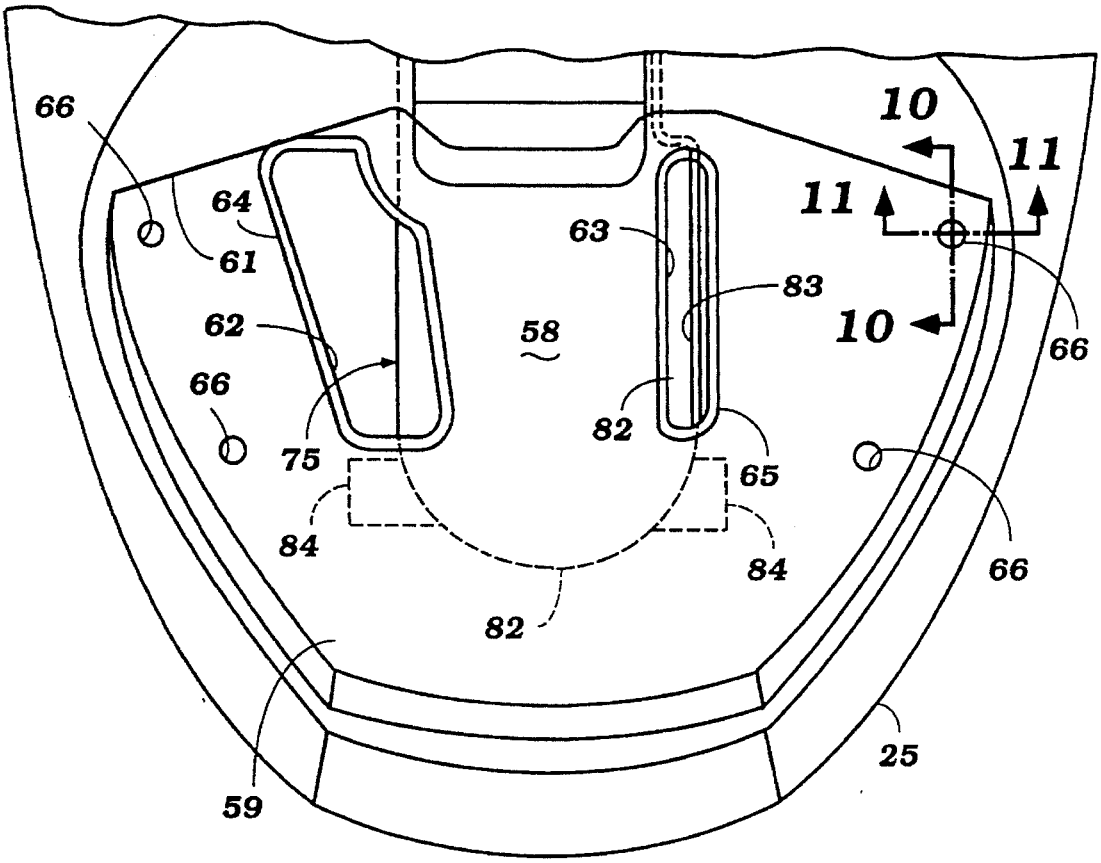
FIG. 8 is a top plan view of the rear portion of the protective cowling with the cover member removed so as to more clearly show the construction and the relationship of the air inlet openings to the engine cover.
Figure 9:
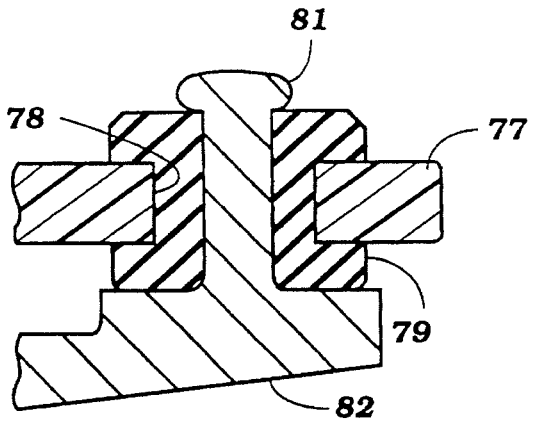
FIG. 9 is a cross-sectional view taken along the line 9—9 of FIG. 3 and shows how the engine cover is attached to the engine.
Figure 10:
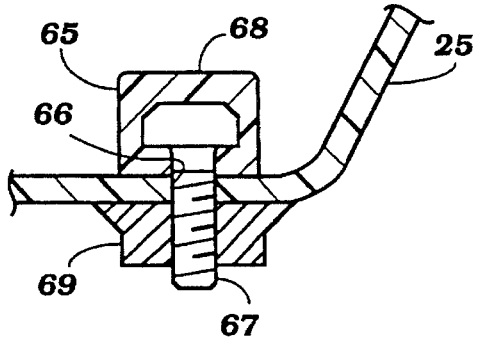
FIG. 10 is a cross-sectional view taken along the line 10—10 of FIG. 8 and shows how the cover piece is affixed to the main housing of the protective cowling.
Figure 11:
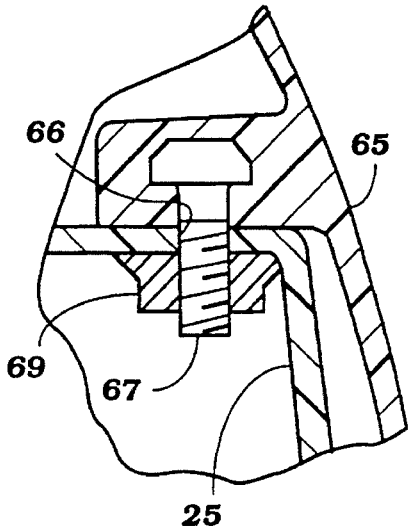
FIG. 11 is a cross-sectional view taken along the line 11—11 of FIG. 8 and further shows the attachment between the cover piece and the main cowling member.

A cover piece, indicated generally by the reference numeral 65 is affixed to the main cowling member 25 by a construction which appears best in FIGS. 8, 10 and 11. This includes a plurality of openings 66 that are formed in the lower wall 59 that defines the recess 58. Each of these openings 66 is adapted to receive the threaded portion of the threaded fastener 67 that is embedded into lugs 68 of the cover piece 65. It should be noted that the cover piece 65 may conveniently be formed from a material such as a molded resinous plastic or the like. Nuts or nut-like elements 69 are threaded onto the threaded portions 67 and thus detachably affix the cover piece 65 to the main cowling member 25.

Figure 6:
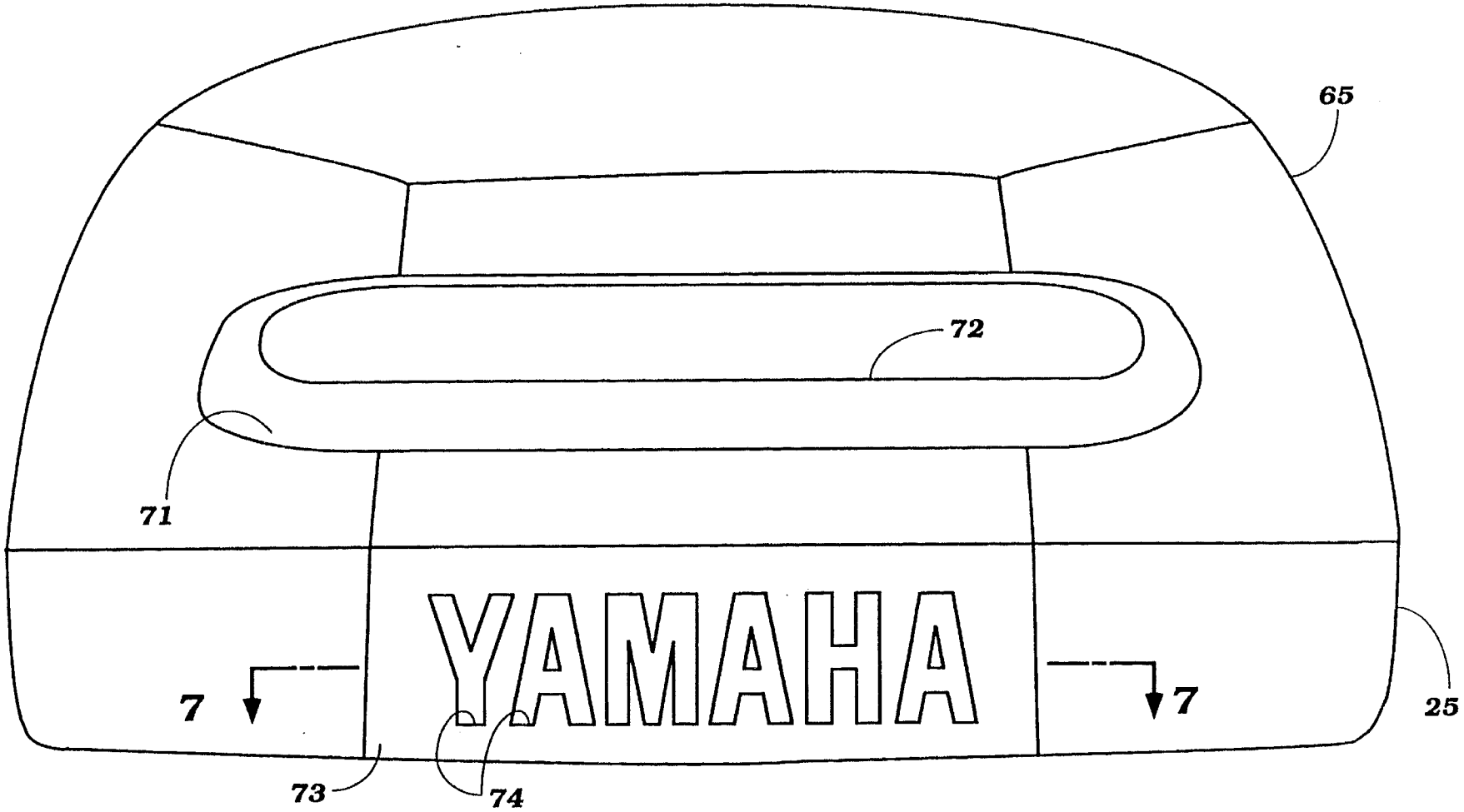
FIG. 6 is an enlarged rear elevational view showing the protective cowling and particularly the air inlet opening thereof.

As may be best seen in FIGS. 2 and 6, the cover piece 65 generally is complimentary in configuration to the main cowling member 25 so as to provide a neat appearance. However, there is an indented portion 71 at the rear of the cover piece 65 that forms an atmospheric air inlet opening 72 which is recessed back into the cover piece 65 so as to provide protection.

As may be seen in FIGS. 2, atmospheric air enters the opening 72 but then must turn and flow upwardly around the upstanding wall 64 and 65 before it can enter the atmospheric air inlet opening 62 and 63 and flow from the cavity 58 into the area around the engine 23. Hence, this tortious path will provide water separation to the inducted air and will remove the larger portion of the water which might otherwise enter the protective cowling. Also, since the opening 72 faces rearwardly, there is less likelihood of water entry.

Figure 7:
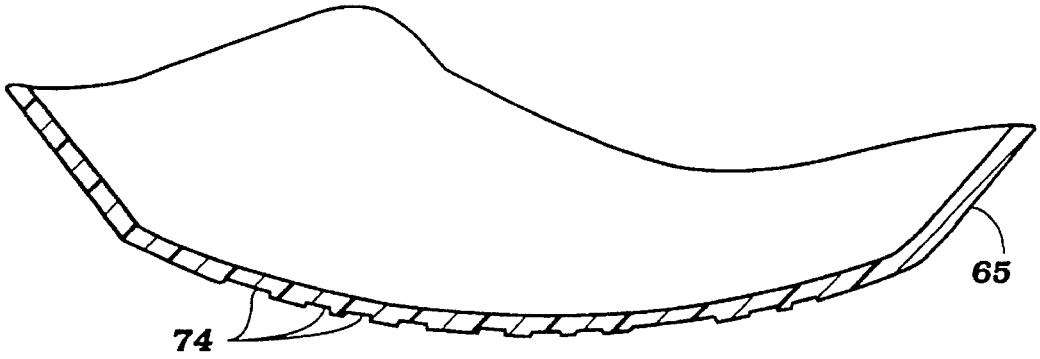
FIG. 7 is a cross-sectional view taken along the line 7—7 of FIG. 6 and shows how the legend is formed in the body of the protective cowling.

Upon sudden decelerations, however, there may be a wave that will splash up from the transom of the watercraft toward the opening 72. This water may enter the cavity 58 but it will enter below the upper ends of the walls 64 and 65 as clearly shown in FIG. 2 and thus will strike the rear wall 61 which, as has been noted, defines a substantial volume so that the water cannot accumulate to a height greater than that of the walls 64 and 65. The water then drains out of a drain passage d that is formed by a downwardly extending portion 73 of the cover piece 65 and which extends into a further recess formed at the rear of the cavity 58 by the main cowling member 25. This portion 73 may be formed with certain legend, as indicated at 74 such as the name of the manufacturer. This legend 74 is formed, as seen in FIG. 7, during the molding process. If desired, the recessed areas may be painted for ease of recognition.

Figure 3:
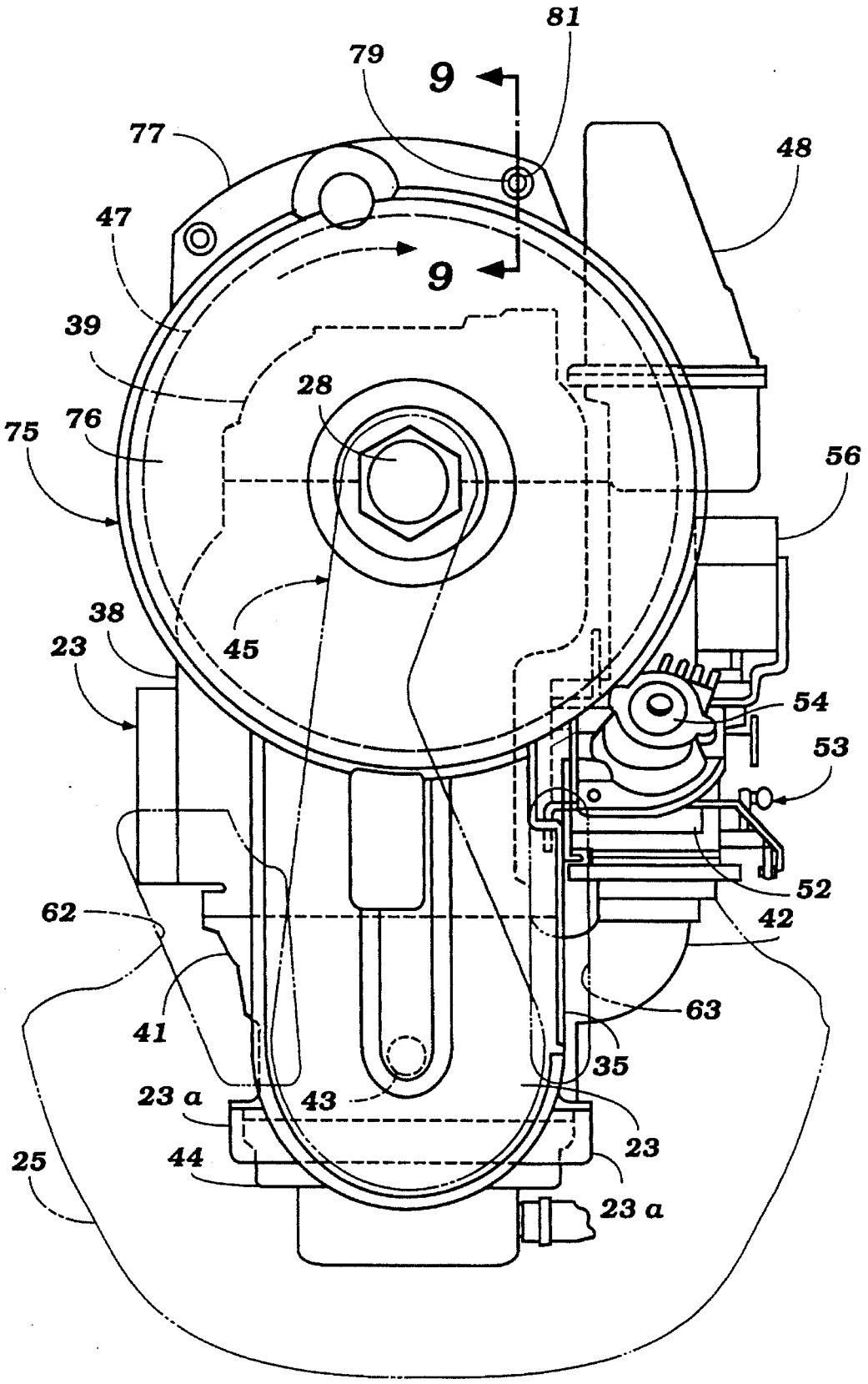
FIG. 3 is a top plan view of the power head with the protective cowling removed but with portions shown in phantom so as to indicate the relationship between the air inlet openings of the main cowling portions and the engine internal protective cover.
Figure 4:
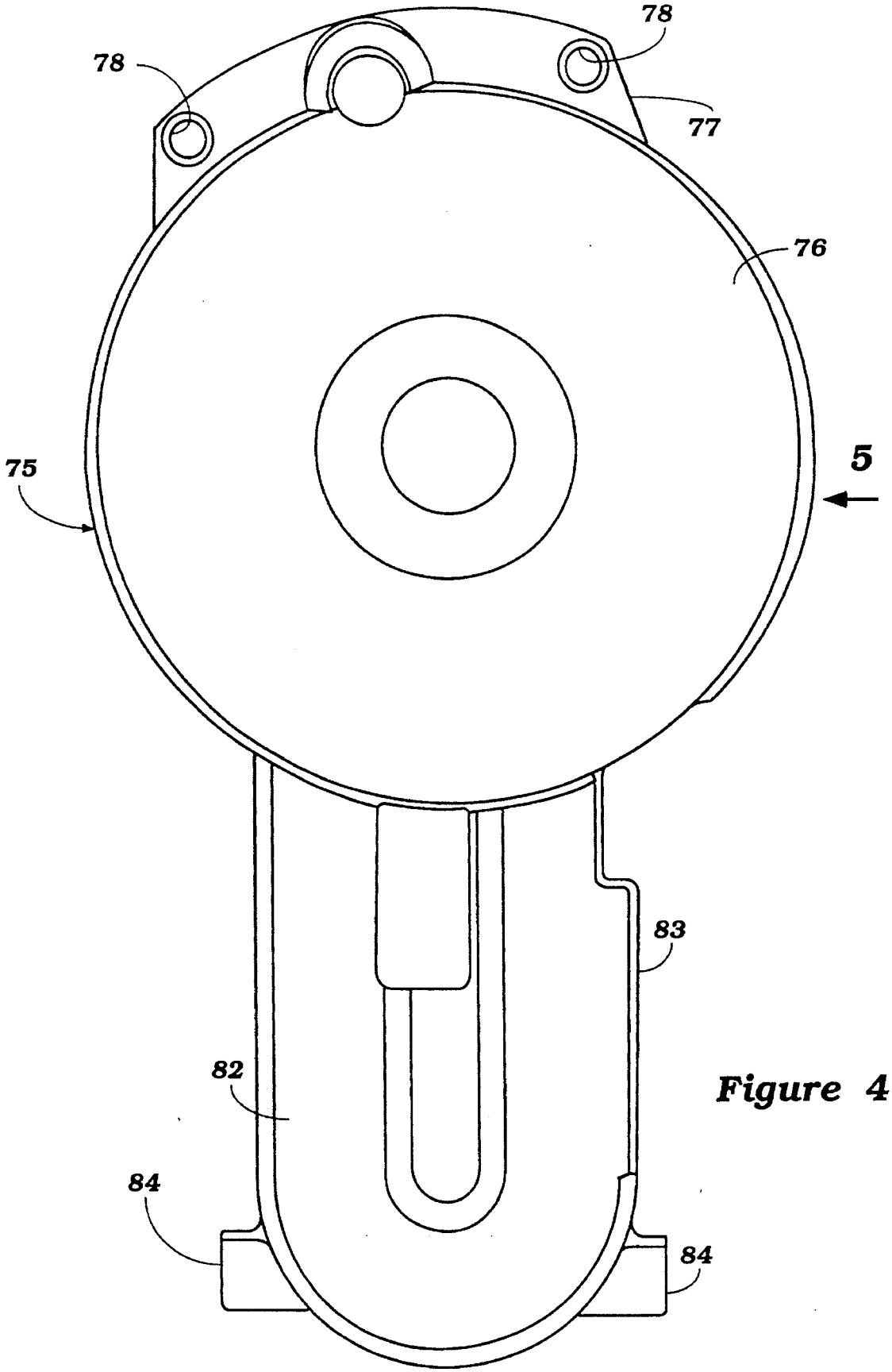
FIG. 4 is an enlarged top plan view of the engine protective cover.
Figure 5:
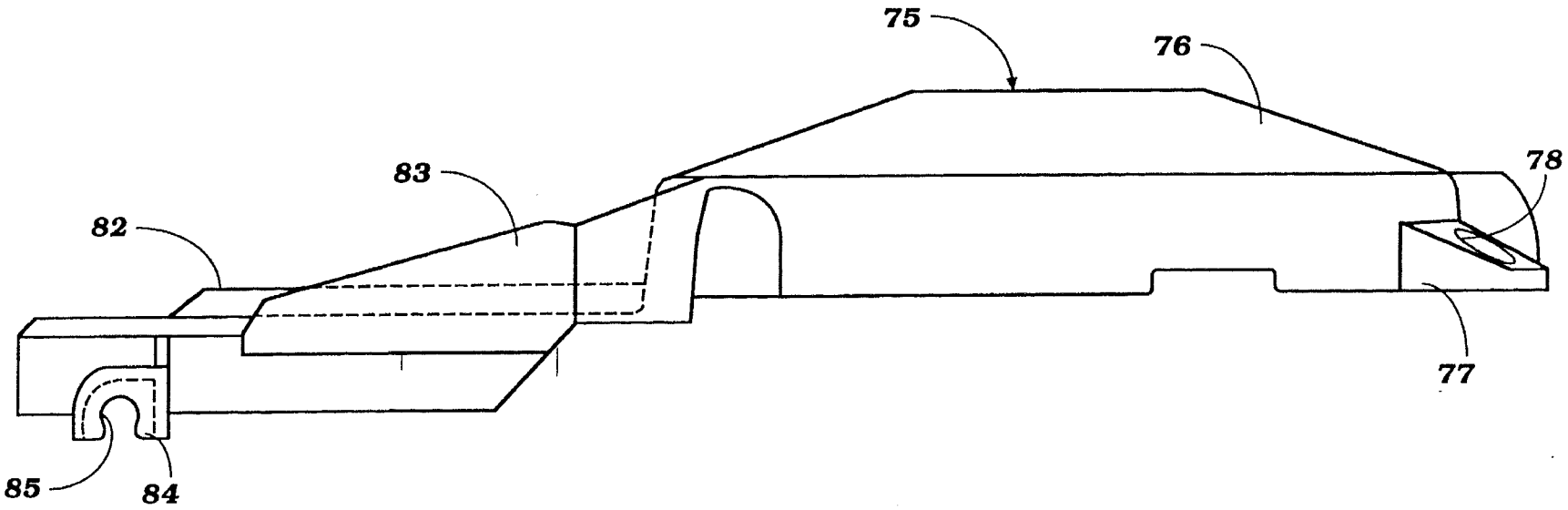
FIG. 5 is a side elevational view looking in the direction of the arrow 5 in FIG. 4.

In addition to the water protection for the engine 23 by the positioning and sizing of the openings 62 and 63 and their surrounding walls 64 and 65, still further protection is provided by an internal engine cover, indicated generally by the reference numeral 75 and which is shown in most detail in FIGS. 2–5, 8 and 9 with FIGS. 3 and 8 particularly showing how this internal engine cover 75 cooperates with the openings 62 and 63. The cover 75 has a first circular portion 76 which is sized so as to overlie the flywheel 46 and starter gear 47 so as to not only offer protection for the engine but also to ensure against an operator being injured if operating the outboard motor with the main cowling portion 25 removed.

This circular portion 76 has an outstanding flange 77 that defines a pair of openings 78 (FIG. 9) that receive elastic grommets 79 which are, in turn, detachably received on a pair of posts 81 formed on an extending piece 82 of the engine assembly so as to mount the engine cover 75 in place.

At one side of the cylindrical portion 76 the engine cover 75 is also formed with a partially oval extending portion 82 that overlies and protects the drive belt 45 for the camshaft 43. As may be seen in FIG. 8, a large portion of the part 82 extends beneath the opening 63 so as to provide still further water protection for the engine and specifically the carburetors and linkage system associated therewith. Any water which may fall down onto the cover portion 82 is captured by an upstanding wall 83 that extends along the carburetor side of the engine and will direct the water toward the portion of the cylinder head 41 and cam cover 44 spaced away from the carburetors 52. This end of the portion 82 is provided with a pair of outstanding flanges 84 which add rigidity to the assembly and which are notched at 85 to be supported on a portion of the engine.

A part of the cover 75 and specifically its portion 82 underlies the opening 62 but since less water protection is required at this side, the amount of this overlap is relatively small.

It should be readily apparent from the foregoing description that the described construction provides very effective water protection for the critical components of the internal combustion engine of the outboard motor while, at the same time, permitting the flow of copious amounts of air to the interior of the protective cowling for engine operation. Of course, the foregoing description is that of a preferred embodiment of the invention and various changes and modifications may be made without departing from the spirit and scope of the invention, as defined by the appended claims.

We claim:

1. A protective cowling for the power head of an outboard motor having an internal combustion engine and comprising a main cowling member covering and substantially enclosing said engine, a pair of air inlet openings formed in said main cowling member and lying on opposite sides of a longitudinally extending center line and above at least in part said engine for admitting atmospheric air to said protective cowling for engine operation, a cover member substantially smaller in top plan view than said main cowling member and affixed to said main cowling member and overlying said openings and defining at least in part an atmospheric air inlet to a chamber formed by said cover member and said main cowling member around said openings, one of said openings being disposed at least in part above components of said engine which should be protected from water damage and said one opening being substantially smaller than the other of said openings.

2. A protective cowling for the power head of an outboard motor as in claim 1, wherein the openings are defined by upstanding walls that terminate beneath the cover member.

3. A protective cowling for the power head of an outboard motor as in claim 2, wherein the openings are formed at the rear of the main cowling member and wherein the atmospheric inlet faces rearwardly.

4. A protective cowling for the power head of an outboard motor as in claim 3, further including an engine cover affixed to the upper side of the engine and having a portion thereof laying substantially under the one opening and obscuring direct flow of water through said one opening onto the engine.

5. A protective cowling for the power head of an outboard motor as in claim 4, wherein the engine cover portion is defined by an upstanding wall disposed at one side of and beneath the opening for channelling water away from the engine components.

6. A protective cowling for the power head of an outboard motor as in claim 1, further including an engine cover affixed to the upper side of the engine and having a portion thereof laying substantially under the one opening and obscuring direct flow of water through said one opening onto the engine.

7. A protective cowling for the power head of an outboard motor as in claim 6, wherein the engine cover portion is defined by an upstanding wall disposed at one side of and beneath the opening for channelling water away from the engine components.

8. A protective cowling for the power head of an outboard motor as in claim 1, wherein the cavity formed by the main cowling member and the cover is defined at the forward end thereof by an upstanding wall that is disposed a substantial distance from the openings so that any water entering through the opening will not flow into the openings.

9. A protective cowling for the power head of an outboard motor as in claim 8, wherein the openings are defined by upstanding walls that terminate beneath the cover member.

10. A protective cowling for the power head of an outboard motor as in claim 9, wherein the openings are formed at the rear of the main cowling member and wherein the atmospheric inlet faces rearwardly.

* * * * *